United States Patent [19]

Babson et al.

[11] 3,970,017

[45] July 20, 1976

[54] FABRIC EDGE FINISHING MACHINES

[75] Inventors: Edward S. Babson, Ipswich; Oliver C. Brett, Jr., West Boxford; Warren A. Cavicchi, Ipswich; Carlton G. Lutts, Salem, all of Mass.

[73] Assignee: USM Corporation, Boston, Mass.

[22] Filed: Nov. 11, 1974

[21] Appl. No.: 522,734

[52] U.S. Cl. ..... 112/121.12; 112/153; 112/205

[51] Int. Cl.[2] ..... D05B 21/00

[58] Field of Search ..... 112/121.12, 121.11, 112/121.15, 153, 203, 204, 205, 122, 2; 271/1; 250/202

[56] References Cited

UNITED STATES PATENTS

| | | | |
|---|---|---|---|
| 1,357,065 | 10/1920 | Loeb | 112/153 |
| 3,034,781 | 5/1962 | Touchman et al. | 271/1 |
| 3,385,245 | 5/1968 | Ramsey et al. | 112/121.12 |
| 3,425,369 | 2/1969 | Kosrow | 112/121.15 |
| 3,722,441 | 3/1973 | Kitchener et al. | 112/205 |
| 3,752,097 | 8/1973 | Fuller, Jr. et al. | 112/121.12 |

*Primary Examiner*—Werner H. Schroeder
*Assistant Examiner*—Peter Nerbun
*Attorney, Agent, or Firm*—Carl E. Johnson; Richard B. Megley; Vincent A. White

[57] ABSTRACT

This invention relates to automatic mechanism for processing the edges of pile type fabrics and the like from which thinner or non-pile margins are to be removed. Fabric edge finishing machines are provided with a means for sensing relative thickness of work piece portions, such as terry material as distinguished from thinner or marginal non-terry portions. Accordingly washcloths and the like, as directed by an edge guide and corner turning mechanism, are under the control of a sensor and are automatically guided through the operating localities of instrumentalities, such as the needle and trimming mechanism of an overedge stitcher, or other edge treating machines, to provide for removal of the non-terry material and processing directly along the edge of the remaining terry material.

9 Claims, 12 Drawing Figures

FABRIC EDGE FINISHING MACHINES

BACKGROUND OF THE INVENTION

There is disclosed in U.S. Pat. No. 3,752,097 issued Aug. 14, 1973, in the names of George A. Fuller, Jr. et al improved mechanism for performing automatically the edge finishing of workpieces, notably those of flexible fabric having peripheries including both straight and curved portions. According to the invention therein set forth an over-edging machine of known type, for instance, is provided with an automatic corner turning mechanism whereby a swing finger and cooperative rotary clamp are operative in response to an external work edge sensor to enable the over-edging machine to progress rapidly over a margin of a rectilinear path, about a convex "corner", and thence along another straight line path. The guidance sensor controls movement of the swing finger and clamp in response to the position of successive peripheral operating points solely along the external margin of the work.

The indicated guidance control has been found to be commercially satisfactory in dealing with such items as most face cloths, small towels, and the like. Some workpieces, however, require a different mode of automatic guidance in determining their ultimate peripheral configuration. One example is conveniently afforded by face cloths and the like which initially have a pile or terry spaced inwardly from a woven margin that is thinner and free of terry material, but which are to be produced wholly free of such margins. That is to say the edge processing such as overedging is to occur directly along the inner edge of terry material. In edge finishing such work it is desirable to automatically guide the work in a manner whereby the terry edge will be progressively relieved of the non-terry material and progressively bound as by overedging. This entails a need for guidance sensing in two modes, as herein shown, not from the initially external perimeter or raw outside edge of the work, but from discriminating the inner demarcation or inner contour provided by the limit of the upstanding loops of terry. At present guidance of flexible workpieces having margins distinctive from their interior is largely manual, relatively slow, and the results not entirely uniform, especially about the convex "corners" of a multisided periphery.

SUMMARY OF THE INVENTION

In view of the foregoing it is an object of this invention to provide an automatic machine for edge finishing workpieces the non-pile margins of which are to be removed to expose its raw pile marginal edges and then simultaneously and progressively finishing these edges.

Another and more specific object of this invention is to provide an automatic guidance mechanism for an overedging machine or the like having conventional work feeding means whereby, when a terry-type workpiece has a relatively thin margin extending along more than one side thereof, the machine can proceed in substantially continuous manner to trim off the marginal edges, impart rounded corner portions, and simultaneously secure as by stitching the terry material along its periphery.

To these ends, and in accordance with a feature of the invention, an overedging machine or the like having an operating tool such as a needle and trimming means such as a reciprocable cutting blade, and a terry edge guide, is provided with control means including a sensing means responsive to the terry material of a workpiece to distinguish it from its non-terry margin, and work turning mechanism including circuitry having a switch responsive to the sensing means. As herein illustrated the sensing means may alternatively be pneumatic or electronic in character. The edge guide is adapted for cooperating with the edge of the terry material for rectilinear guidance thereby. The sensing means is adapted to signal appropriately for corner turning between adjacent angularly related work edges. Since in the manufacturing of terry material, for instance, the line of demarcation between the terry and the non-terry of the margins is commonly well delineated, a reliable and useful control signal is derived to produce quality products in rapid manner. The invention thus extends the utility and versatility of conventional overedging machines without burdening an operator.

While as herein shown the invention is embodied in a machine having swingable arm type corner turning mechanism such as disclosed in the cited Fuller et al patent, it will be understood that the invention may also be employed in combination with other suitable automatic corner turning means.

It will be appreciated that application of the invention is not limited to the operation on pile-type four-cornered fabric workpieces, but may likewise have utility on any multi-sided, margin-carrying flexible workpiece of leather, paper, or plastic sheet material required to be marginally trimmed i.e. have its external border eliminated and then edge treated as by sewing and/or some other function such as bonding, printing, embossing, etc.

BRIEF DESCRIPTION OF THE DRAWINGS

The foregoing and other features of the invention together with novel details in construction will now be more particularly described in connection with two illustrative embodiments, and with reference to the accompanying drawings thereof, in which.

DESCRIPTION OF PREFERRED EMBODIMENTS

Figure 2:
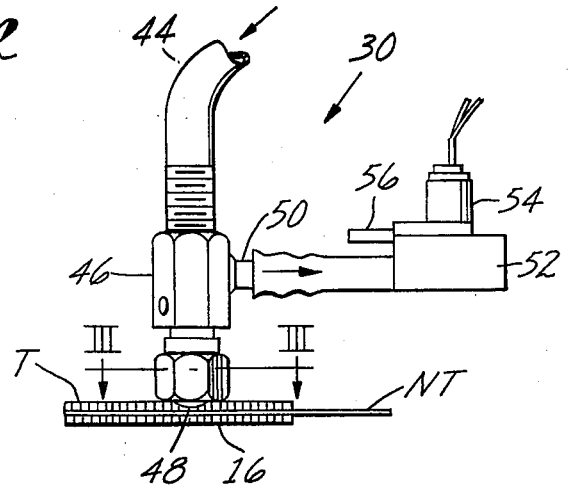
FIG. 2 is a view in side elevation, and on a larger scale, of a pile pneumatic sensor and control shown in FIG. 1 for actuating corner turning of a partly pile workpiece and energizing corner counting mechanism embodied in the machine of FIG. 1.

Unless hereinafter indicated it may be assumed that construction of the illustrative embodiments now to be explained generally corresponds to that fully disclosed in the cited U.S. Pat. No. 3,752,097. Distinguishing features will now be explained in detail, referring first to the embodiment shown in FIGS. 1–8 inclusive. Like parts in the alternative embodiments bear the same reference characters.

Figure 3:
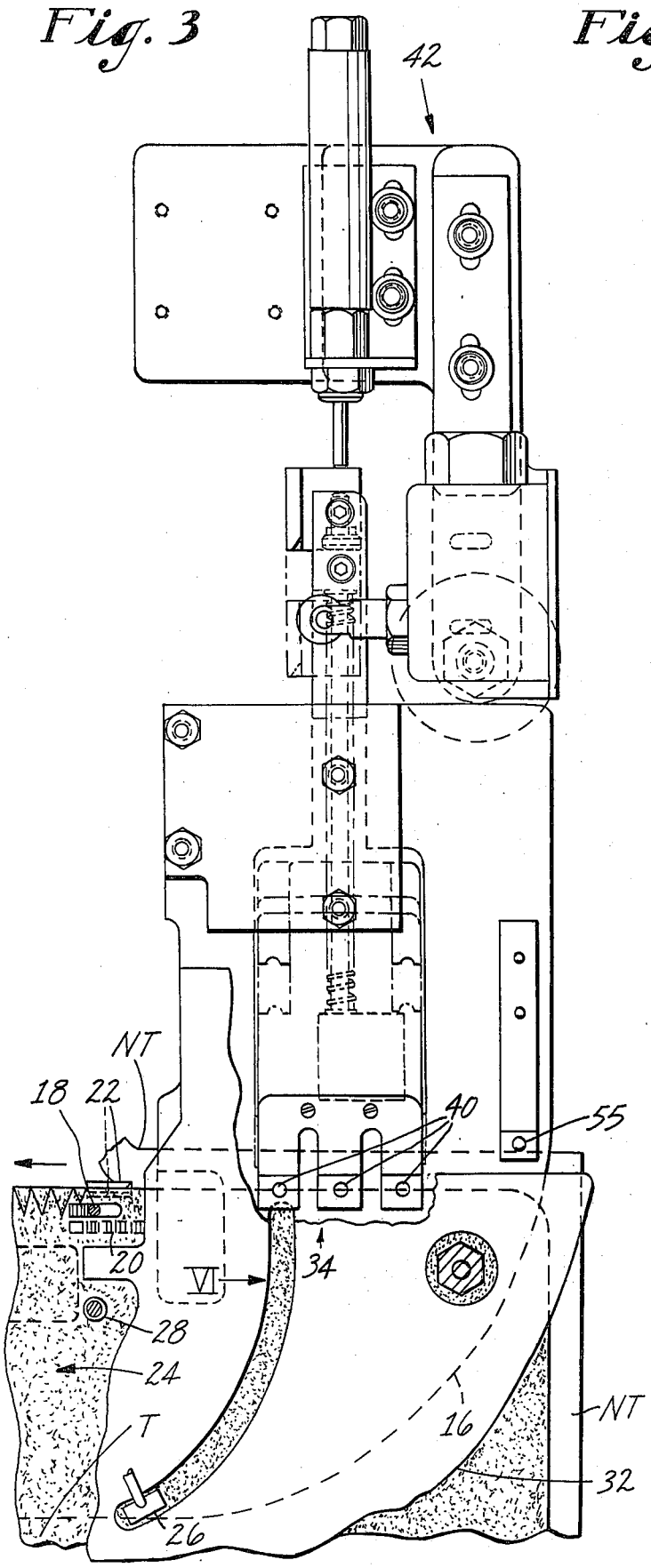
FIG. 3 is an enlarged plan view taken on the section III—III of FIG. 2 (corresponding largely to FIG. 8 of the U.S. Pat. No. 3,752,097) showing a substituted pile edge guide and a pile sensor control as disposed relative to stitching means and corner turning means.
Figure 4:
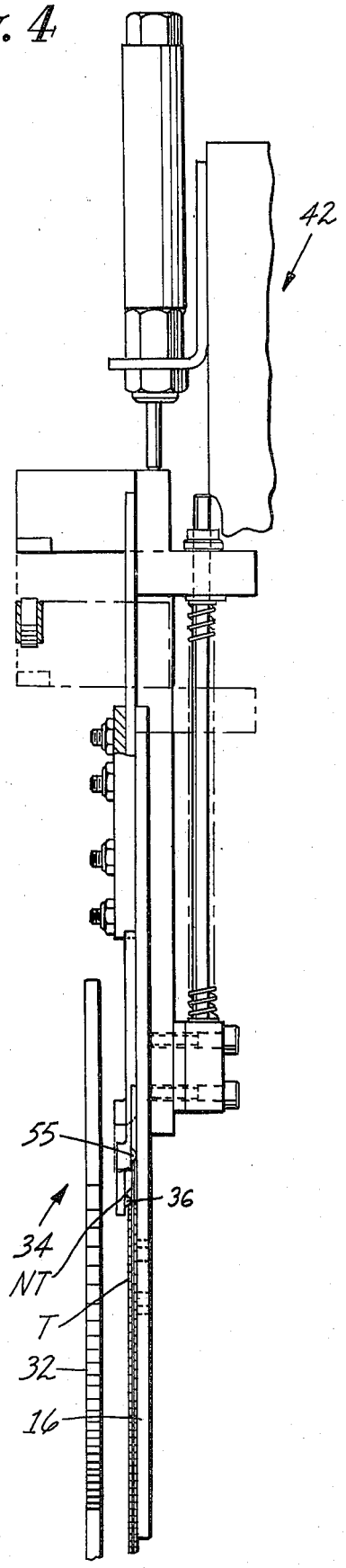
FIG. 4 is a view in side elevation of the mechanism shown in FIG. 3.
Figure 8:
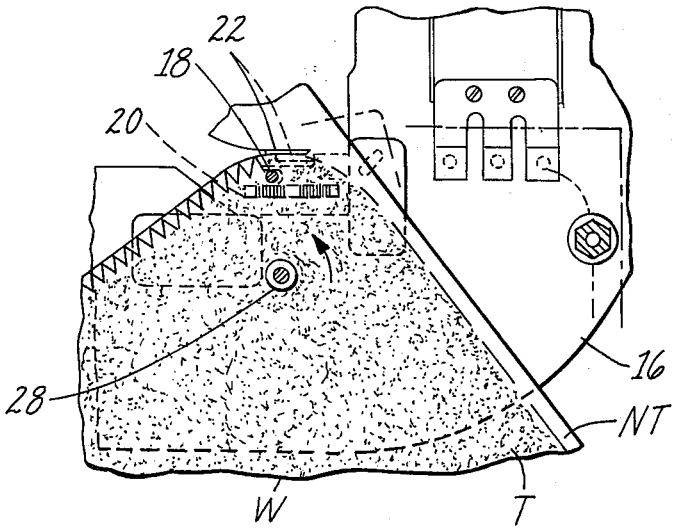
FIG. 8 is a plan view corresponding to a part of FIG. 3, showing counter-clockwise corner turning of the workpiece.
Figure 9:
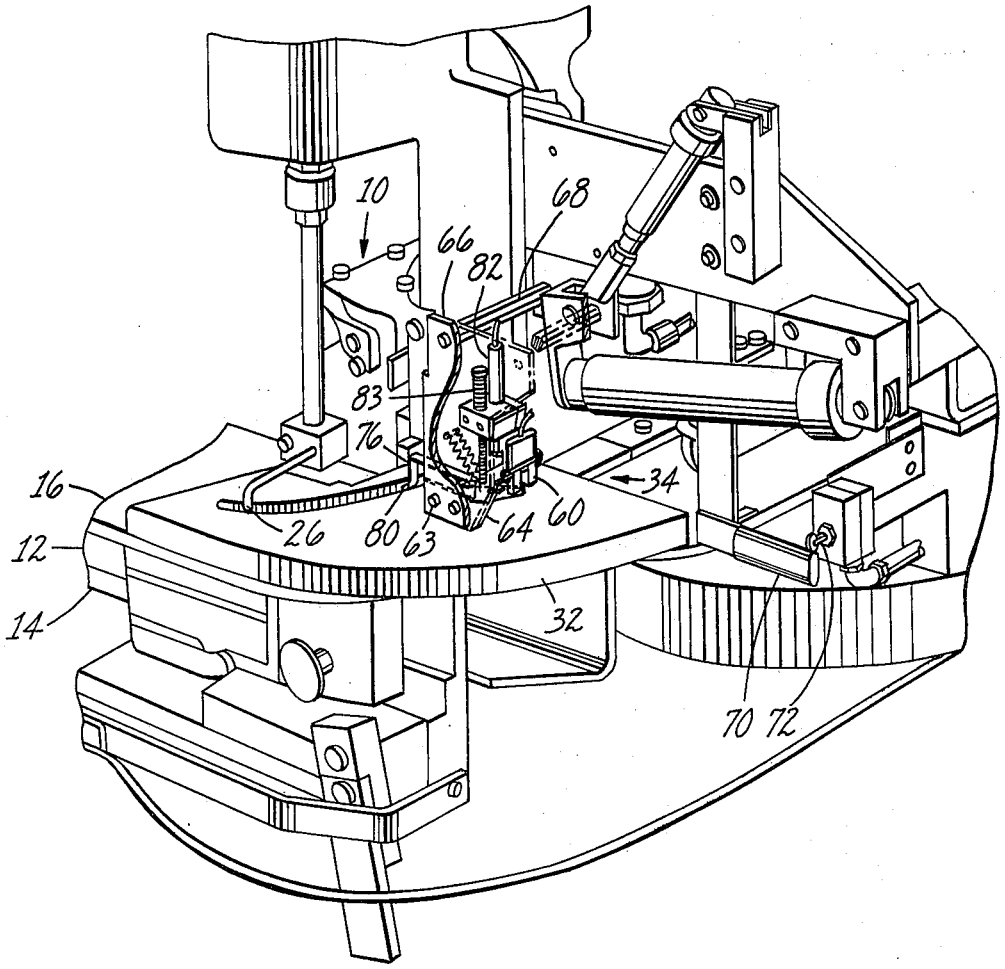
FIG. 9 is a view generally similar to FIG. 1 but showing an alternative and generally preferred arrangement embodying electronic sensing for corner turning control.

An edge finishing machine 10 (FIG. 1) which may, for instance, be an overedging machine of commercially available type is secured to a plate 12 bolted onto a table 14. A work supporting bed 16 secured to the plate 12 is cut away to accommodate a finishing tool such as a reciprocable needle 18 (FIGS. 3, 5, and 8) of the machine, and usual rectilinear feed dog and presser foot mechanism 20 (FIGS. 3 and 8). Additionally, the machine includes an adjacent pair of margin trimming shears 22, 22 (FIG. 8). Further, the present machine arrangement comprises a suitable corner turning mechanism generally designated 24 (FIGS. 1 and 3) which may, as hitherto disclosed, include a work swinging finger 26 and yieldable rotary clamp 28 cooperative to determine a fixed turning center about which the workpiece will be swung as the margin trimming and overedging operations progress, preferably with no decrease of speed. A corner counting mechanism (not herein shown) preferably is provided together with an automatic kick-out mechanism 29 (FIG. 1) of the type disclosed in said patent for automatically ejecting work at the end of a completed cycle of edging operations.

Figure 1:
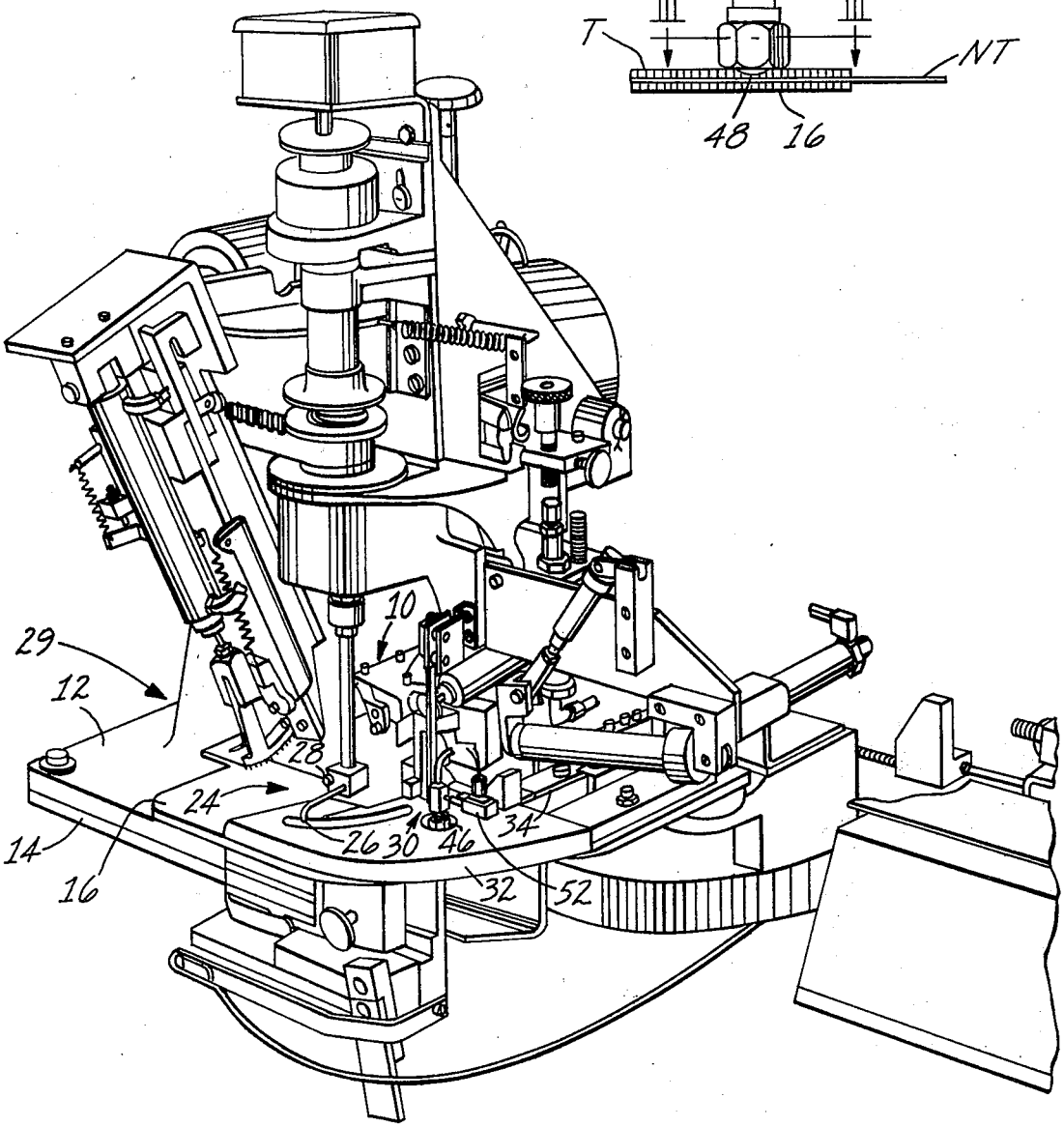
FIG. 1 is a prespective view of an edge finishing machine of the type disclosed in the above mentioned U.S. Pat. No. 3,752,097, modified by pneumatic guidance mechanism as herein described to enable non-terry margins of multi-sided workpieces to be removed, and the outer edges of terry material to be secured as by overedging along the terry edge.
Figure 5:
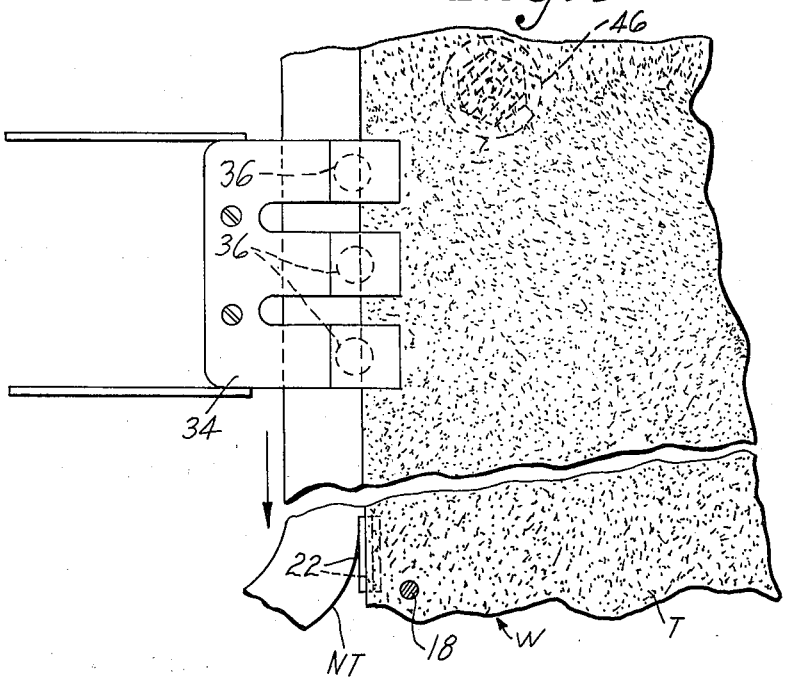
FIG. 5 is a plan view indicating the pile edge guide and relative operating positions of a trimming knife, needle operating point, and the sensor control of FIG. 2.

Control of the corner turning mechanism 24 in the present invention, instead of being responsive to a light beam interruptible by the workpiece as hitherto, resides in a sensing means competent to distinguish the presence of thicker, i.e. pile vs. non-pile material and is herein shown in one form as a pneumo-electric sensor generally designated 30 (FIGS. 1 and 2). This sensor 30 is fixedly mounted and has its lower end receivable in, and extending through, an opening in a vertically movable work-spreading plate 32 overlying the work bed 16. Preferably, and as shown in FIGS. 3, 5, and 8, the sensor 30 later to be described is initially disposed for operation inwardly of a workpiece margin and just ahead of an edge guide generally designated 34 (FIGS. 3, 5, and 8) now to be explained.

Figure 6:
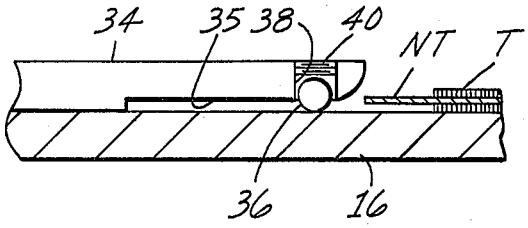
FIG. 6 is a section taken on the line V—V of FIG. 3 and showing initial presentation of the workpiece.
Figure 7:
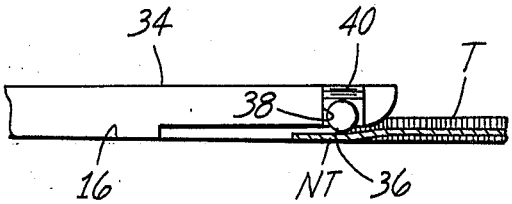
FIG. 7 is a view similar to FIG. 6, the work now being guided on its pile edge.

The guide 34 is normally arranged to overlie the bed 16 in alignment with the rectilinear path of feed effected by the mechanism 20, and is adapted to provide work guidance as afforded by the rectilinear edge of the pile or terry material, herein designated T, as distinguished from the non-terry marginal material designated NT to be removed. For this purpose the guide 34 preferably has its forward end portion undercut as shown at 35 in FIG. 6 to permit all non-terry margin material to be removed regardless of its width and comprises 2 or more gages in the form of balls 36 (three herein shown) respectively nested in vertical sockets or bores 38 (FIGS. 6 and 7). Each bore 38 threadedly receives an adjustable stop 40. The arrangement is such that margin material NT, being thinner, can slide under the balls 36 when they are in cooperative relation to the work supporting bed 16, but the terry material T is too thick to slide under the balls which are then prevented from sufficient upward displacement by the adjusted stops 40.

As in the patented arrangement, the rearward end of the guide 34 is desirably connected to sew-off actuating means 42 (FIG. 3) operable in response to a signal from the mentioned corner counting mechanism, for thrusting the guide forwardly against a return spring after the last work corner has been processed. This action urges the margin of the work forwardly from beneath the presser foot and hence enables the kick-out mechanism 29 to then free the work from the machine.

The control sensor 30 (FIG. 2) is herein shown as fluid pressure actuated, but it will be appreciated alternative sensor types may be substituted therefor. Air under pressure from a source (not shown) is continuously admitted via a tube 44 (FIG. 2) to the sensor 30 and is vented from an escape orifice formed in a sensing head 46 adapted to distinguish terry material T from the non-terry NT. For this purpose the non-terry can ineffectually influence air flow upon sliding beneath a workengageable ball 48 loosely nested in the head 46, but when the thicker edge of terry material T engages the ball 48 to displace it upwardly, the entering air from the tube 44 is backed up through a passageway 50 extending from the head 46 to a pilot valve 52 housing a piston (not shown) for actuating an electrical switch 54. Accordingly the restriction of the escape orifice by the terry builds back pressure adequate to shift the valve and hence actuate the switch 54. Though not herein shown, means preferably is provided whereby the edge guide body 34 is adjustable heightwise relative to the work support 16 to accommodate different ranges of thicknesses of work material.

The arrangement is such that the workpiece W is initially presented to the edge guide 34 as shown in FIG. 5, a straight edge of the terry T being guided by the balls 36, and the terry T then engaging the control sensor ball 48 as indicated in FIG. 3 and thereby causing closure of the electrical switch 54. Slightly inward of the line of balls 36, another ball 55 (FIGS. 3 and 4) is disposed to serve as a fixed stop or guard preventing excessive inward movement of the work. When relative linear movement of the work W has resulted in trimming and overedging along the straight edge of the terry T to the extent that the sensor ball 48 rides off the terry and onto the non-terry margin NT, or completely off the work as shown is FIG. 8, air can escape from the head 46 at a higher rate, and the pilot valve piston will automatically shift to open the switch 54. Air is then admitted into 1 of 2 inlets 56 (only one is shown in FIG. 2). As a consequence a signal is transmitted to effect operation of the corner turning clamp 28 and the swing finger 26 counterclockwise as seen in FIG. 8. Without interruption of the overedger 10, the work W is thereby swung counterclockwise about the turning center at the axis of the clamp 28, and trimming and stitching proceed along a circular path, usually a 90° arc or "corner," at the terry edge. The trimming precedes the overedging at all times as indicated in FIG. 5. The radius of the work corners to be finished is determined by the spacing of the turning center of the clamp 28 from the line determined by the terry work contact points of the guide balls 36.

It will be apparent that each operation of the corner turning mechanism 24 is effective, through control circuitry substantially as disclosed in the mentioned patent, to bring the terry material T again under the control sensor ball 48 whereupon the resultant air restriction causes the switch 54 to be closed and work turning to be terminated. Rectilinear work feeding, trimming, and overedging accordingly now resume along a straight path determined by the next straight edge of terry to be processed and the guide 34 cooperating therewith.

In the manner indicated the successive non-pile side margins of pile-type workpieces are removed by the shears 22 and the remainder overedged along a pile or terry edge including the interconnecting rounded corners of selected curvature which are produced by the corner turning mechanism 24. In some instances the latter will derive its signal for operation from change in the material beneath the ball 48 from terry material to a non-terry margin, and at other times, because of the nature of the original workpiece, such signal will occur upon a terry portion (already extending to a work edge) passing under the ball 48 and no margin contacting the ball 48. It will be apparent that inclusion of the corner counting and/or the kick-out features are not necessary to usage of this invention, but their application is found particularly convenient in combination with the guide 34 and the control sensor 30 for automatically edge finishing large numbers of workpieces.

Figure 11:
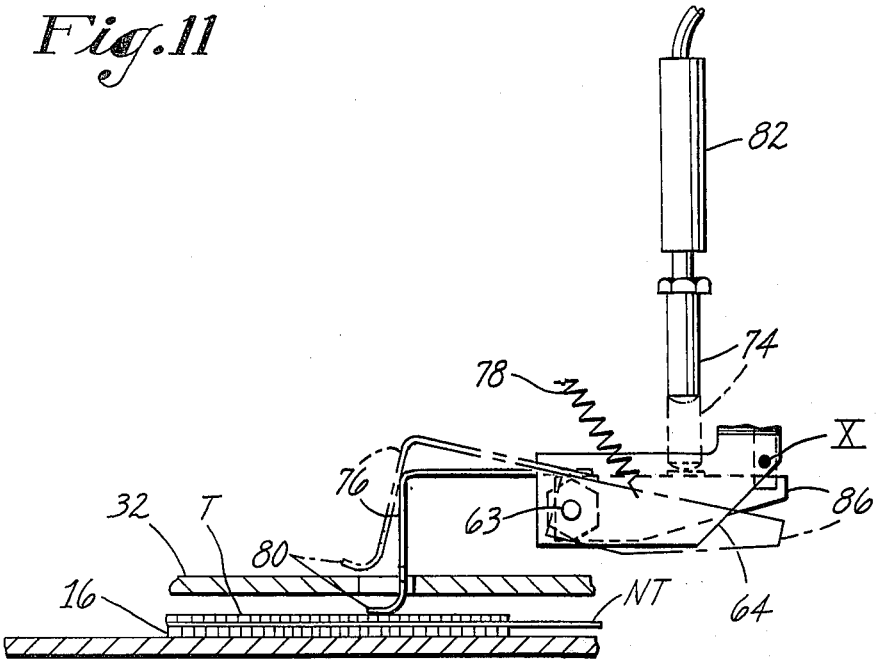
FIG. 11 is a view in front elevation of portions of the sensing means shown in FIG. 10, in both operative and inoperative positions.
Figure 10:
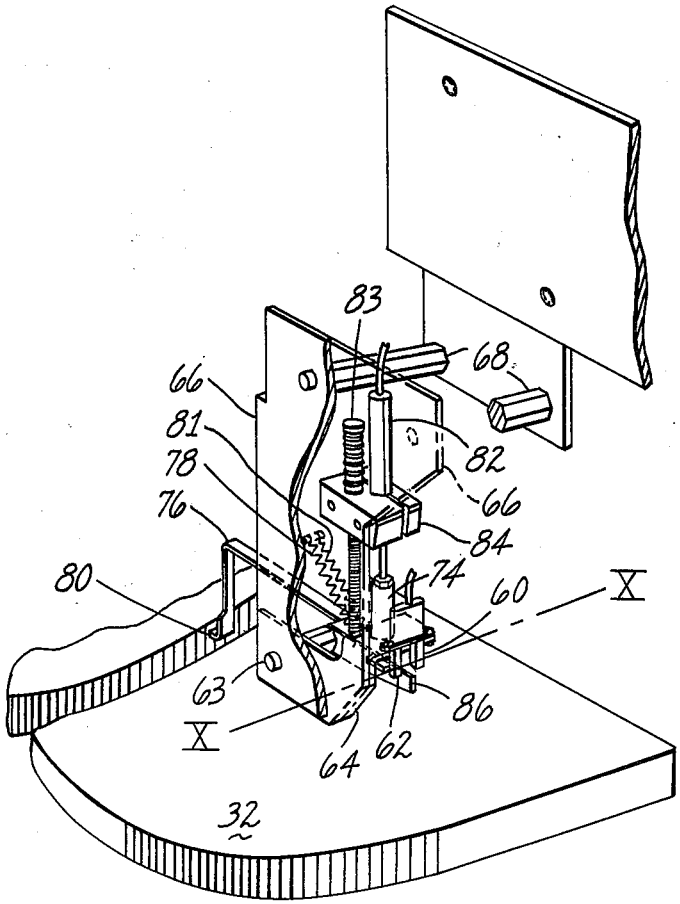
FIG. 10 is an enlarged view of the corner turning control means shown in FIG. 9.
Figure 12:
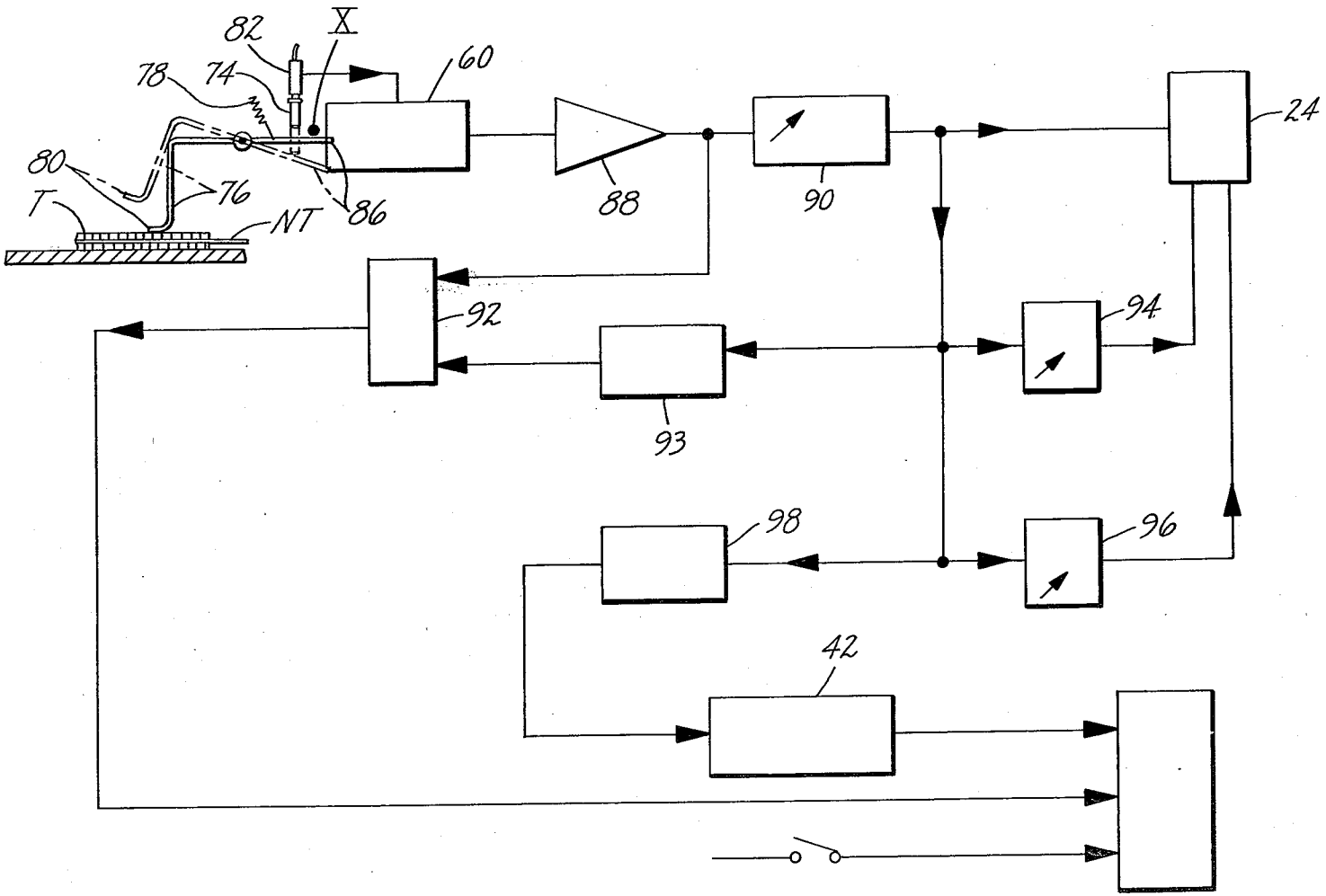
FIG. 12 is a schematic functional block diagram of an electrical circuit controlling corner turning in the FIG. 9 arrangement.

As an alternative to the pneumatic sensing means above explained, an electronic arrangement often preferred for controlling corner turning will next be described with reference to FIGS. 9–12 inclusive. An electronic sensor responsive to a beam from a light source, for instance a photo-coupler 60 (FIGS. 9, 10 and 12) responsive to a light beam emitted along an axis X—X by a suitable source 62, is provided. For this purpose the sensor and beam source are supported on an angular arm 64 pivotally mounted on a horizontal pin 63 carried by a vertical plate 66 secured by pins 68,68 to the machine frame. when a start lever 70 (FIGS. 9 and 12) is manually actuated to operate a switch 72, a piston rod 74 (FIGS. 9, 10 and 12) is deactivated, allowing a thickness sensing finger 76 (FIGS. 9–12) to be pivoted independently on the pin 63 (counterclockwise as seen in FIG. 11) by a spring 78 so that a lower, sometimes rounded (and sometimes flat depending on surface texture) end 80 of the finger may yieldingly contact the presented terry material, i.e. be shifted from the dash line position shown in FIG. 11 to the lower full line operating position indicated. This finger is then ready to sense the first work "corner" as it approaches the operating instrumentalities. The piston rod 74 is vertically operable against spring return in an air cylinder 82 held by a clamping block 84 secured to the plate 66. A tension spring 81 connected to a pin projecting from the plate 66 yieldingly maintains the arm 64 in contact with the lower end of a vertically adjustable stop screw 83 threaded through the block 84 thereby enabling the detecting mechanism to be suitably adjusted for different thicknesses of pile material.

It will be understood from the foregoing that, when the work contacting end 80 is in normal work contacting position, i.e. engaging the work surface at its effective level, an opposite end 86 of the finger 76 is disposed just beneath the beam axis X—X. As soon as the finger end 80 under influence of the spring 78 drops off the edge of the terry material T, or more precisely the terry pile moves away from the end 80, the change is detected by the photo-coupler 60 by reason of the mentioned opposite end 86 of the finger rising to block the beam X. As a consequence of this beam interception an output signal from the photo-coupler 60 is sent to an amplifier 88 (FIG. 12) and also fed, as amplified, to an adjustable turn start timer 90 and a test circuit 92. This circuit 92 checks to determine at the start and end of each corner turning operation if a "no terry material" condition exists by "looking" at the state of the terry sensor 76 after a predetermined interval on the order, for instance, of 0.4 seconds. If the sensor 76 then indicates a "no terry material" condition exists at that time a stop cycle signal is generated at block 93 (FIG. 12) as a safety measure. When the delay of the start timer 90 expires, effective operation of the corner turning mechanism 24 commences rotating the workpiece in a manner similar to that indicated in FIG. 8. Simultaneous with the mentioned signal from the photo-coupler 60, its output is employed to activate the cylinder 82 and advance its rod 74 downwardly whereby the finger sensing end 80 is lifted to permit the workpiece corner portion to be swung without interference therefrom. As herein shown (FIG. 9) the sensing finger 76 is movable into and out of work contact by extending into and out of the same slot in the plate 32 that receives the swing finger 26.

The duration of corner turning is adjustable in novel manner in this electronic mode of control to properly allow for the different degree of stretchiness (and possibly difference in handling characteristic) encountered in almost all fabric materials when proceeding with the warp or the woof of a woven fabric of given weight. For this purpose the time of corner turning at the first and third corners of the washcloth, for instance, will be determined by a variable time delay 94, and similarly the corner turning time in which the mechanism 24 is operative at the second and fourth work corners (assuming 90° arcs) will be determined by a variable time delay 96. At termination of each corner turning and accompanying edge finishing, the cylinder 82 is again deactivated to allow the finger end 80 to contact the work on its terry surface in readiness to sense arrival of a next "corner". A corner counting mechanism 98, which may be of the type disclosed in an earlier U.S. Pat. No. 3,722,441, for instance, is provided to determine the last corner to be processed whereupon the workpiece will be sewn off automatically, for example, by actuation of the sew-off actuating means 42, and then ejected by the kick-out mechanism 29 (FIG. 1). The illustrative machine may be provided with automatic work stacking means (not shown) such as the type disclosed in U.S. Pat. No. 3,848,866 based on an application filed Mar. 22, 1972 in the names of G. A. Fuller et al, and wherein the cycles of operation of the machine are coordinated with those of the stacker.

Having thus described our invention what we claim as new and desire to secure as Letters Patent of the United States is:

1. An automatic edge finishing machine for removing non-terry margin material, if any, from terry-type material and edge finishing the latter comprising, in combination with a machine having a work support, an operating tool, trimming means, and mechanism for feeding the work on the support to and through the operating locality of the tool and of the trimming means, an edge guide formed and disposed over the support to clear the non-terry material and progressively abut the edge of the terry material, and automatic work guidance mechanism including a sensor spaced from the edge guide and in advance of the tool for distinguishing the effective level of the surface of the terry-type material on said support from the non-terry margin material and responsively causing the trimming means and the tool to operate progressively along the edge of the terry material as the work is fed by the work feeding mechanism.

2. A machine as in claim 1 wherein the guidance mechanism includes an electric circuit for controlling turning movement of the terry material as it is fed in its general plane, and the sensor comprises a pneumatic sensing head and a switch means actuatable thereby, the head having a passageway for air flow controlling the switch means and a displaceable element adapted to be relatively movable in the head on engagement with the terry material edge to affect the rate of air flow and hence operation of the switch means.

3. A machine as in claim 1 wherein the edge guide comprises a body disposed with more than one recess formed in alignment with the trimming means, and a plurality of work contactable gages constrained for limited heightwise movement in the respective recesses and in cooperative relation with the work support whereby the gages can clear the margins of the work and provide rectilinear guidance for the edge of the terry material engaged thereby.

4. A machine as in claim 3 wherein the gages are in the form of balls and the recesses threadably receive, respectively, an adjustable heightwise limiting stop therefor.

5. In combination with a sewing machine having stitching instrumentalities including a reciprocable needle, a reciprocable edge trimmer, a work support and means for rectilinearly feeding multi-sided flexible workpieces on the support to and through the operating localities of the needle and the trimmer, each piece initially having a thicker inner portion delineating it from its margins, and edge guide having an undercut end adapted to guide the workpieces along the edges of the thicker portion, a corner turning mechanism, and an automatic work guidance control mechanism including a sensor for actuating the corner-turning mechanism, the sensor being responsive to distinction of the margins from the thicker material and being spaced ahead of the knife and needle and more inwardly of the work than the needle whereby each piece is progressively trimmed of its margins as the thicker portion has its corners rounded and edges stitched.

6. A machine for finishing the terry edge of a fabric having an interior of terry material initially bounded on one or a plurality of sides by non-terry margins, the machine comprising the combination with an edge treating mechanism, a trimming means adjacent to said mechanism, means for linearly feeding the fabric through the operating locality of the trimming means and of the edge treating mechanism, and an edge guide aligned with the trimming means and inlcuding elements vertically displaceable by the margins within limits for guiding the fabric along the edge of the terry material ahead of the trimming, a corner turning mechanism for exerting a torque on a portion of the fabric to urge it about a turning center, and a control circuit for said corner turning mechanism, said control circuit including a sensor responsive to transition of a sensed work locality from terry to non-terry or no work material to signal for actuation of the corner turning mechanism.

7. A machine as in claim 6 wherein the sensor of said control circuit comprises a finger having a fabric engaging end portion movably mounted for shifting between positions above and below an adjustable predetermined work sensing level with the terry material, the circuit comprises a light responsive means, an amplifier, and a time delay means for energizing the corner turning means, and another portion of the finger is arranged to actuate the light responsive means when a light beam, normally directed to said light responsive means, is intercepted upon said finger end portion descending below the work sensing level.

8. A machine as in claim 6 wherein the control circuit comprises a time delay means including two alternately operable, variable time delays for automatically accommodating the difference in stretchiness of the fabric when operations progress between successive corners of the fabric.

9. A machine as in claim 7 further comprising spring means for yieldingly urging said finger end portion against the terry material at the work sensing level, pressure means engageable with the sensor finger for overcoming the spring means to position the finger heightwise out of interference relation with the path of the movement of the fabric, and an operative connection between the control circuit and the pressure means for actuating the latter automatically to clear the finger from the fabric when it is being turned.

* * * * *